US007170378B2

(12) United States Patent
Fujiwara et al.

(10) Patent No.: US 7,170,378 B2
(45) Date of Patent: Jan. 30, 2007

(54) MAGNETIC CORE FOR HIGH FREQUENCY AND INDUCTIVE COMPONENT USING SAME

(75) Inventors: Teruhiko Fujiwara, Sendai (JP); Akiri Urata, Sendai (JP); Akihisa Inoue, 11-806, Kawauchijutaku, 35, Kawauchi Motohasekura, Aoba-ku, Sendai-shi, Miyagi (JP)

(73) Assignees: NEC Tokin Corporation, Sendai (JP); Akihisa Inoue, Sendai (JP)

( * ) Notice: Subject to any disclaimer, the term of this patent is extended or adjusted under 35 U.S.C. 154(b) by 0 days.

(21) Appl. No.: 10/548,286

(22) PCT Filed: Aug. 20, 2004

(86) PCT No.: PCT/JP2004/012317

§ 371 (c)(1),
(2), (4) Date: Sep. 1, 2005

(87) PCT Pub. No.: WO2005/020252

PCT Pub. Date: Mar. 3, 2005

(65) Prior Publication Data

US 2006/0170524 A1 Aug. 3, 2006

(30) Foreign Application Priority Data

Aug. 22, 2003 (JP) ..... 2003-298548
Mar. 19, 2004 (JP) ..... 2004-080802

(51) Int. Cl.
*H01F 27/02* (2006.01)

(52) U.S. Cl. ..... 336/83; 148/304

(58) Field of Classification Search ..... 336/65, 336/83, 212, 233–234; 252/62.51–62; 148/300–303, 148/304–314

See application file for complete search history.

(56) References Cited

U.S. PATENT DOCUMENTS 4,385,932 A * 5/1983 Inomata et al. ..... 148/304

(Continued)

FOREIGN PATENT DOCUMENTS

DE 34355519 A1 4/1985

(Continued)

OTHER PUBLICATIONS

Patent Abstracts of Japan vol. 2002, No. 11 Nov. 6, 2002 of JP 2002 194514 A (Japan Science & Technology Corp.), Jul. 10, 2002.

(Continued)

*Primary Examiner*—Tuyen T Nguyen
(74) *Attorney, Agent, or Firm*—Frishauf, Holtz, Goodman & Chick, P.C.

(57) ABSTRACT

A high-frequency core is a molded body obtained by molding a mixture of a soft magnetic metallic glass powder and a binder in an amount of 10% or less in mass ratio. The powder has an alloy composition represented by a general formula $(Fe_{1-a-b}Ni_aCo_b)_{100-x-y-z}(M_{1-p}M'_p)_xT_yB_z$ (where $0 \leqq a \leqq 0.30$, $0 \leqq b \leqq 0.50$, $0 \leqq a+b \leqq 0.50$, $0 \leqq p \leqq 0.5$, 1 atomic $\% \leqq x \leqq 5$ atomic %, 1 atomic $\% \leqq y \leqq 12$ atomic %, 12 atomic $\% \leqq z \leqq 25$ atomic %, $22 \leqq (x+y+z) \leqq 32$, M being at least one selected from Zr, Nb, Ta, Hf, Mo, Ti, V, Cr, and W, M' being at least one selected from Zn, Sn, R (R being at least one element selected from rare earth metals including Y), T being at least one selected from Al, Si, C, and P). An inductance component includes the high-frequency core and at least one turn of winding wound around the core.

17 Claims, 2 Drawing Sheets

U.S. PATENT DOCUMENTS

| | | | | |
|---|---|---|---|---|
| 5,976,274 | A * | 11/1999 | Inoue et al. | 148/304 |
| 6,172,589 | B1 * | 1/2001 | Fujita et al. | 335/306 |
| 6,280,536 | B1 * | 8/2001 | Inoue et al. | 148/302 |
| 6,350,323 | B1 * | 2/2002 | Inoue et al. | 148/304 |
| 6,897,718 | B2 * | 5/2005 | Yoshida et al. | 327/552 |
| 2001/0036084 | A1 | 11/2001 | Yoshida et al. | |
| 2005/0254989 | A1 | 11/2005 | Fujiwara et al. | |

FOREIGN PATENT DOCUMENTS

| | | | |
|---|---|---|---|
| EP | 0 899753 | A1 | 3/1999 |
| JP | 4-286305 | A | 10/1992 |
| JP | 5-299232 | A | 11/1993 |
| JP | 7-34183 | A | 2/1995 |
| JP | 11-74111 | A | 3/1999 |
| JP | 11-131199 | A | 5/1999 |
| JP | 2001-64704 | A | 3/2001 |
| JP | 2001-678324 | A | 3/2001 |
| JP | 2001-189211 | A | 7/2001 |
| JP | 2002-105502 | A | 4/2002 |
| JP | 2002-151317 | A | 5/2002 |
| JP | 2002-184616 | A | 6/2002 |
| JP | 2002-194514 | A | 7/2002 |
| JP | 2002-305108 | A | 10/2002 |
| JP | 2003-142319 | A | 5/2003 |
| JP | 2004-363235 | A | 12/2004 |
| JP | 2004-363466 | A | 12/2004 |

OTHER PUBLICATIONS

Patent Abstracts of Japan vol. 1995, No. 05 Jun. 30, 1995 of JP 07 034183 A (Kawasaki Steel Corp.) Feb. 3, 1995.

Patent Abstracts of Japan vol. 2002, No. 08, Aug. 5, 2002 of JP 2002 105502 A (Kubota Corp.), Apr. 10, 2002.

U.S. Appl. No. 11/125,747, filed May 9, 2005.

* cited by examiner

MAGNETIC CORE FOR HIGH FREQUENCY AND INDUCTIVE COMPONENT USING SAME

CROSS-REFERENCE TO RELATED APPLICATION

This application is a United States national phase application under 35 USC 371 of International application PCT/JP2004/012317 filed on Aug. 20, 2004.

TECHNICAL FIELD

This invention relates to a high-frequency core mainly using a soft magnetic material and an inductance component using the core.

BACKGROUND ART

Heretofore, generally as a material of a high-frequency core, soft ferrite, high-silicon steel, an amorphous metal, a powder core, and the like have mainly been used. The reason why the above-mentioned materials are used is as follows. In case of the soft ferrite, the material itself has a high specific resistance. In case of other metal materials, the material may be formed into a thin plate or a powder so as to reduce an eddy current although the material itself has a low specific resistance. The above-mentioned materials are selectively used depending upon a working frequency or an intended use. Summarizing the reason therefor, the material high in specific resistance, such as the soft ferrite, has a low saturation magnetic flux density while the material high in saturation magnetic flux density, such as the high-silicon steel, has a low specific resistance. Thus, a magnetic material having both of a high saturation magnetic flux density and a high specific resistance is not yet provided.

In the meanwhile, following dramatic progress in reduction in size and improvement in function of various electronic apparatuses in recent years, a coil and a transformer are required to be reduced in size and to have an inductance under a large direct current. In order to satisfy the above-mentioned demand, it is necessary to simultaneously improve a saturation magnetic flux density and a high-frequency loss characteristic of the core. Further, due to copper loss resulting from an electric resistance of a winding coil, heat generation of the coil or the transformer is increased. Therefore, it is also desired to provide a method for suppressing temperature elevation.

In case of the soft ferrite, improvement of the saturation magnetic flux density is considered but, actually, no substantial improvement is made. In case of the high-silicon steel or the amorphous metal, the material itself has a high saturation magnetic flux density. However, in order to adapt to a high-frequency band, the material must be formed into a thinner plate as the frequency band is higher. A multilayer core using such material is lowered in space factor, which may result in decrease in saturation magnetic flux density. Further, in case of the powder core, it may be possible to achieve a high specific resistance by inserting an insulating material between fine powder particles and to achieve a high saturation magnetic flux density by high-density molding. However, there are difficult problems to solve. That is, a method of improving saturation magnetization of a soft magnetic powder used therefor and a method of forming a high-density molded body while maintaining insulation between powder particles are not established at present.

In order to remedy the above-mentioned problems, in particular, the problem that a magnetic material having both of a saturation magnetic flux density and a high specific resistance is difficult to obtain, proposal is made of a powder core and a method of producing the same in which a metallic glass powder is used as a soft magnetic powder, mixed with an insulating material, and formed into a molded body at a temperature not lower than a normal temperature so as to obtain a soft magnetic material having a high permeability with a relatively excellent frequency characteristic (see Japanese Unexamined Patent Application Publication (JP-A) No. 2001-189211, hereinafter referred to as a patent document 1).

Herein, there are various kinds of alloy compositions collectively called a metallic glass. However, alloy compositions used as the soft magnetic material are restricted to Fe-based alloys which are generally classified into a PeP-CBSiGa alloy composition and a FeSiBM (M being a transition metal) alloy composition. The patent document 1 uses the former, i.e., an alloy having the FePcBSiGa alloy composition and discloses that, by the use of this soft magnetic material, excellent magnetic characteristics capable of achieving a high specific resistance and a high saturation magnetic flux density are obtained. It is noted here that the latter, i.e., the FeSiBM alloy composition is also disclosed (see Japanese Unexamined Patent Application Publications (JP-A) Nos. 2002-194514 and H11-131199, hereinafter referred to as patent documents 2 and 3, respectively). Further, it is also disclosed to use the soft magnetic material for a core (see Japanese Unexamined Patent Application Publication (JP-A) No. H11-74111, hereinafter referred to as a patent document 4).

On the other hand, it is disclosed to form a winding coil and a metal powder into an integral structure with a reduced size so that d.c. superposition characteristics are improved (see Japanese Unexamined Patent Application Publications (JP-A) Nos. H04-286305 and 2002-305108, hereinafter referred to as patent documents 5 and 6, respectively).

In case of the above-mentioned soft magnetic materials suitable as the high-frequency core, for example, in case of the FePCBSiGa alloy composition disclosed in the patent document 1, magnetic characteristics including a high permeability with a relatively excellent frequency characteristic are obtained. In this case, however, it is necessary to use an expensive metal such as Ga. This results in a problem that the material itself is high in cost and, therefore, promotion of industrial application is inhibited. On the other hand, in the FeSiBM alloy composition disclosed in the patent documents 2 and 3 and considered about application to the core in the patent document 4, the material itself is excellent in economical efficiency. However, in these documents, no technique for obtaining a high specific resistance and a high magnetic flux density is shown (this is presumably because a method of forming a molded body suitable for the alloy composition is not found). Thus, at present, it is difficult to use the material for the high-frequency core and an inductance component using the same. The patent documents 5 and 6 disclose reduction in size of the coil. However, because an existing soft magnetic metal material is used, reduction of loss is not sufficient.

This invention has been made in order to solve the above-mentioned problems. It is an object of this invention to provide an inexpensive high-frequency core made of a soft magnetic material having a high saturation magnetic flux density and a high specific resistance and to provide an inductance component using the same.

DISCLOSURE OF THE INVENTION

According to the present invention, there is provided a high-frequency core comprising a molded body obtained by molding a mixture of a soft magnetic metallic glass powder and a binder in an amount of 10% or less in mass ratio with respect to the soft magnetic metallic glass powder, the soft magnetic metallic glass powder having an alloy composition represented by a general formula $(Fe_{1-a-b}Ni_aCo_b)_{100-x-y-z}(M_{1-p}M'_p)_xT_yB_z$ (where $0 \leqq a \leqq 0.30$, $0 \leqq b \leqq 0.50$, $0 \leqq a+b \leqq 0.50$, $0 \leqq p \leqq 0.5$, 1 atomic % $\leqq x \leqq$ 5 atomic %, 1 atomic % $\leqq y \leqq$ 12 atomic %, 12 atomic % $\leqq z \leqq$ 25 atomic %, $22 \leqq (x+y+z) \leqq 32$, M being at least one selected from Zr, Nb, Ta, Hf, Mo, Ti, V, Cr, and W, M' being at least one selected from Zn, Sn, R (R being at least one element selected from rare earth metals including Y), T being at least one selected from Al, Si, C, and P).

In the high-frequency core according to this invention, the total amount of Al, C, and P is preferably 0.5% or less in mass ratio. The molded body preferably has a powder filling rate of 50% or more, a magnetic flux density of 0.5 T or more when a magnetic field of $1.6 \times 10^4$ A/m is applied, and a specific resistance of $1 \times 10^4$ Ωcm or more.

Further, in the high-frequency core according to this invention, the molded body is preferably obtained by preparing the mixture of the soft magnetic metallic glass powder and the binder in an amount of 5% or less in mass ratio with respect to the soft magnetic metallic glass powder and compression-molding the mixture using a die. The molded body preferably has a powder filling rate of 70% or more, a magnetic flux density of 0.75 T or more when a magnetic field of $1.6 \times 10^4$ A/m is applied, and a specific resistance of 1 Ωcm or more.

Further, in the high-frequency core according to this invention, the molded body is preferably obtained by preparing the mixture of the soft magnetic metallic glass powder and the binder in an amount of 3% or less in mass ratio with respect to the soft magnetic metallic glass powder and compression-molding the mixture using a die under a temperature condition not lower than a softening point of the binder. The molded body preferably has a powder filling rate of 80% or more, a magnetic flux density of 0.9 T or more when a magnetic field of $1.6 \times 10^4$ A/m is applied, and a specific resistance of 0.1 Ωcm or more.

Further, in the high-frequency core according to this invention, the molded body is preferably obtained by preparing the mixture of the soft magnetic metallic glass powder and the binder in an amount of 1% or less in mass ratio with respect to the soft magnetic metallic glass powder and compression-molding the mixture at a temperature within a supercooled liquid temperature range of the soft magnetic metallic glass powder. The molded body preferably has a powder filling rate of 90% or more, a magnetic flux density of 1.0 T or more when a magnetic field of $1.6 \times 10^4$ A/m is applied, and a specific resistance of 0.01 Ωcm or more.

In the high-frequency core according to this invention, the soft magnetic metallic glass powder is preferably produced by water atomization or gas atomization and at least 50% of powder particles preferably have a size not smaller than 10 μm.

In the high-frequency core according to this invention, a soft magnetic alloy powder having an average diameter smaller than that of the soft magnetic metallic glass powder and a low hardness is preferably added in an amount of 5–50% in volume ratio.

In the high-frequency core according to this invention, the soft magnetic metallic glass powder preferably has an aspect ratio (long axis/short axis) within a range between 1 and 3.

In the high-frequency core according to this invention, it is preferable that the molded body is heat treated at a temperature not lower than a Curie point of the alloy powder after molding and that $SiO_2$ is contained at least in a part of an intermediate material between powder particles of the alloy powder.

According to this invention, there is also provided an inductance component comprising the high-frequency core described in one of the above-mentioned paragraphs and at least one turn of winding wound around the core. Preferably, the inductance component has a gap formed at a part of a magnetic path of the high-frequency core.

According to this invention, there is also provided the above-mentioned high-frequency core in which the soft magnetic metallic glass powder has a maximum particle size of 45 μm or less and an average diameter of 30 μm or less in mesh size. In the high-frequency core, the total amount of Al, C, and P is preferably 0.5% or less in weight ratio.

In the high-frequency core according to this invention, a soft magnetic alloy powder having an average diameter smaller than that of the soft magnetic metallic glass powder and a low hardness is preferably added in an amount of 5–50% in volume ratio.

There is provided an inductance component comprising the high-frequency core mentioned above and including a winding coil embedded in a magnetic body and formed by press-molding into an integral structure.

In the inductance component in one of the above-mentioned paragraphs, it is preferable that the high-frequency core has a powder filling rate of 50% or more and that a peak value of Q (1/tan δ) is 40 or more at 500 kHz or more.

In the inductance component in one of the above-mentioned paragraphs, it is preferable that the high-frequency core has a maximum powder particle size of 45 μm or less and an average diameter of 20 μm or less and that a peak value of Q (1/tan δ) is 50 or more at 1 MHz or more.

In the inductance component in one of the above-mentioned paragraphs, heat treatment at a temperature not higher than 600° C. is preferably performed.

BEST MODE FOR EMBODYING THE INVENTION

Figure 1:
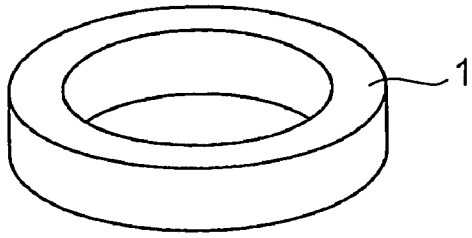
FIG. 1 is an external perspective view showing a basic structure of a high-frequency core according to one embodiment of this invention.

This invention will be described further in detail.

As a result of extensive studies, the present inventors have found out that, if an alloy composition of (Fe, Co, Ni)—(Al, Si, C, P)—B-MM' as a FeSiBMM' (M=at least one selected from Zr, Nb, Ta, Hf, Mo, Ti, V, Cr, and W, M'=at least one selected from Zn, Sn, and R (where R being at least one element selected from rare earth metals including Y)) based alloy is selected as a soft magnetic metallic glass powder excellent in economic efficiency, the powder excellent in magnetic characteristics and glass forming performance is obtained. It has also been found out that, if a powder core is obtained by subjecting the powder to oxidization or insulating coating and then forming the powder into a molded body by an appropriate molding method using a die or the like, the powder core is a high-permeability powder core exhibiting an excellent permeability over a wide band and an excellent performance which has never been achieved, and that, as a result, a high-frequency core made of a soft magnetic material having a high saturation magnetic flux density and a high specific resistance can be produced at a low cost. Further, it has been found out that an inductance component obtained by providing the high-frequency core with at least one turn of winding is inexpensive and has a high performance as never before.

The present inventors also found out that, by limiting a particle size of the soft magnetic metallic glass powder represented by the above-mentioned composition formula, the powder core is excellent in core loss at a high frequency. Further, it has been found out that an inductance component obtained by providing the high-frequency core with at least one turn of winding is inexpensive and has a high performance as never before. It is also found out that, by press forming in the state where a winding coil is embedded in a magnetic body to form an integral structure, an inductance component adapted to a high-frequency large-current application is obtained.

In order to increase the specific resistance of the molded body, the alloy powder before molding may be subjected to oxidizing heat treatment in atmospheric air. In order to form the molded body having a high density, molding may be carried out at a temperature not lower than a softening point of the resin as the binder. In order to achieve a higher density of the molded body, molding may be carried out in a supercooled liquid temperature range of the alloy powder.

Specifically, the soft magnetic metallic glass powder has an alloy composition represented by a formula $(Fe_{1-a-b}Ni_aCo_b)_{100-x-y-z}(M_{1-p}M'_p)_xT_yB_z$ (where $0 \leqq a \leqq 0.30$, $0 \leqq b \leqq 0.50$, $0 \leqq a+b \leqq 0.50$, $0 \leqq p \leqq 0.5$, 1 atomic % $\leqq y \leqq$ 12 atomic %, 12 atomic % $\leqq z \leqq$ 25 atomic %, $22 \leqq (x+y+z) \leqq 32$, M being at least one selected from Zr, Nb, Ta, Hf, Mo, Ti, V, Cr, and W, M' being at least one selected from Zn, Sn, R (R being at least one element selected from rare earth metals including Y), T being at least one selected from Al, Si, C, and P). The molded body is obtained by molding a mixture of the soft magnetic metallic glass powder and a binder of a predetermined amount in mass ratio with respect to the soft magnetic metallic glass powder.

Herein, description will be made of the alloy composition of the soft magnetic metallic glass powder. Fe as a main component is an element contributing to magnetism and is essential in order to achieve a high saturation magnetic flux density. A part of Fe may be replaced by Ni and/or Co in a ratio of 0 to 0.5 each or in total. Such substitute component has an effect of improving a glass forming performance. Herein, the substitute ratio of Ni is 0 to 0.3. In particular, Co is expected to have an effect of simultaneously improving the saturation magnetic flux density. The total amount of Fe and the substitute element or elements is within a range not smaller than 68 atomic % and not greater than 78 atomic % with respect to a whole of the alloy powder. This is because, unless the amount is 68 atomic % or more, the saturation magnetic flux density is too low and the usefulness is lost and, if the amount is greater than 78 atomic %, the permeability of the core and the core loss are degraded due to crystallization.

The element M is a transition metal element necessary to improve the glass forming performance and is at least one selected from Zr, Nb, Ta, Hf, Mo, Ti, V, Cr, and W. The content of the element M is not smaller than 1 atomic % and not greater than 5 atomic %. This is because if the content is smaller than 1 atomic %, the glass forming performance is decreased and the permeability and the core loss are remarkably deteriorated and, if the content exceeds 5 atomic %, the saturation magnetic flux density is decreased and the usefulness is lost. By replacing the ratio of 0 to 0.5 of the element M by Zn, Sn, R (R being at least one element selected from rare earth metals including Y), the ratio of Fe, Co, Ni can be increased without deteriorating the glass forming performance, so that the saturation magnetic flux density can be improved.

Si and B are elements which are essential in order to produce the soft magnetic metallic glass powder. The amount of Si is within a range not smaller than 1 atomic % and not greater than 12 atomic %. The amount of B is within a range not smaller than 12 atomic % and not greater than 25 atomic %. This is because, if the amount of Si is smaller than 1 atomic % or greater than 12 atomic % or if the amount of B is smaller than 12 atomic % or greater than 25 atomic %, the glass forming performance is degraded and a stable soft magnetic glass powder can not be produced. Herein, Si may be replaced by Al, P, and C. The total amount of Al, P, and C is not greater than 0.5 mass % because, beyond the above-mentioned range, amorphous forming performance is seriously deteriorated and, therefore, predetermined characteristics can not be obtained.

The soft magnetic metallic glass powder is produced by water atomization or gas atomization. Preferably, at least 50% of particle sizes are not smaller than 10 μm. In particular, the water atomization is established as a method of producing the alloy powder at a low cost and in a large amount. To be able to produce the powder by this method is a very large advantage in industrial application. However, in case of a conventional amorphous composition, the alloy powder of 10 μm or more is crystallized so that the magnetic characteristics are significantly deteriorated. As a result, the product yield is seriously deteriorated so that the industrial application is prevented. On the other hand, the soft magnetic metallic glass powder according to this invention is easily vitrified (amorphized) if the particle size is 150 μm or less. Therefore, the product yield is high. Thus, the soft magnetic metallic glass powder of this invention is highly advantageous in view of the cost. In addition, in the alloy powder produced by water atomization, an appropriate oxide coating film is already formed on a powder surface. Therefore, by mixing a resin with the alloy powder and molding the mixture to form a molded body, a core having a high specific resistance is easily obtained.

In either of the alloy powder produced by water atomization and the alloy powder produced by gas atomization, a more excellent oxide coating film is formed if heat treatment is carried out in atmospheric air under a temperature condition not higher than a crystallization temperature of the alloy powder used. In this event, the specific resistance of the core can be increased so that the core loss of the core can be reduced.

On the other hand, for an inductance component intended for higher-frequency applications, an eddy current loss can be reduced by the use of a metal powder having a very small particle size. However, with an alloy composition known in the art, oxidation of the powder during production is remarkable if the average diameter is 30 μm or less. Therefore, predetermined characteristics are difficult to obtain in the powder produced by a typical water atomization apparatus. However, the metallic glass powder is excellent in corrosion resistance of the alloy and is therefore advantageous in that the powder reduced in amount of oxygen and having excellent characteristics can relatively easily be produced even if the powder is very small.

Next, the method of molding the molded body will be described. Basically, a binder such as a silicone resin in an amount of 10% in mass ratio is mixed with the soft magnetic metallic glass powder. Using a die or by molding, the molded body is obtained. The molded body serves as a high-frequency core having a powder filling rate of 50% or more, a magnetic flux density of 0.5 T or more upon application of a magnetic field of $1.6\times10^4$ A/m, and a specific resistance of $1\times10^4$ cm. Herein, the amount of the binder is 10% or less in mass ratio. This is because, if the amount exceeds 10%, the saturation magnetic flux density becomes equivalent to or lower than that of ferrite and the usefulness of the core is lost. The molded body may be obtained by preparing a mixture of the soft magnetic metallic glass powder and the binder in an amount of 5% or less in mass ratio with respect to the soft magnetic metallic glass powder and compression-molding the mixture using a die. In this case, the molded body has a powder filling rate of 70% or more, a magnetic flux density of 0.75 T or more when a magnetic field of $1.6\times10^4$ A/m is applied, and a specific resistance of 1 Ωcm or more. When the magnetic flux density is 0.75 T or more and the specific resistance is 1 Ωm or more, the characteristics are more excellent as compared with a Sendust core and the usefulness is further improved. Further, the molded body may be obtained by preparing a mixture of the soft magnetic metallic glass powder and the binder in an amount of 3% or less in mass ratio with respect to the soft magnetic metallic glass powder and compression-molding the mixture using a die under a temperature condition not higher than a softening point of the binder. In this case, the molded body has a powder filling rate of 80% or more, a magnetic flux density of 0.9 T or more when a magnetic field of $1.6\times10^4$ A/m is applied, and a specific resistance of 0.1 Ωcm or more. When the magnetic flux density is 0.9 T or more and the specific resistance is 0.1 Ωm or more, the characteristics are more excellent as compared with any powder core commercially available at present and the usefulness is further improved. Further, the molded body may be obtained by preparing a mixture of the soft magnetic metallic glass powder and the binder in an amount of 1% or less in mass ratio with respect to the soft magnetic metallic glass powder and compression-molding the mixture in a supercooled liquid temperature range of the soft magnetic metallic glass powder. In this case, the molded body has a powder filling rate of 90% or more, a magnetic flux density of 1.0 T or more when a magnetic field of $1.6\times10^4$ A/m is applied, and a specific resistance of 0.01 Ωcm or more. When the magnetic flux density is 1.0 T or more and the specific resistance is 0.01 Ωm or more, the magnetic flux density is substantially equivalent to that of a multilayer core including an amorphous metal and a high-silicon steel plate in a practical region. However, the molded body herein obtained is small in hysteresis loss and high in specific resistance so that the core loss characteristic is much superior. Thus, the usefulness as a core is further improved.

Furthermore, after molding, the molded body as the high-frequency core may be subjected to heat treatment under a temperature condition not higher than the Curie point as a strain-relieving heat treatment. In this event, the core loss is further reduced and the usefulness as a core is further improved. Herein, it is desired that $SiO_2$ is contained at least in a part of an intermediate material between particles of the alloy powder in order to maintain insulation between the particles (alternatively, all of the intermediate material may be $SiO_2$).

If an inductance component is produced by providing the above-mentioned high-frequency core with at least one turn of winding after a gap is formed at a part of a magnetic path if necessary, a product exhibiting high permeability in a high magnetic field and having excellent characteristics is produced.

FIG. 1 is an external perspective view showing a basic structure of a high-frequency core 1 according to one embodiment of this invention. FIG. 1 shows a state where the high-frequency core 1 using the above-mentioned soft magnetic metallic glass powder is formed into a ring-shaped plate.

Figure 2:
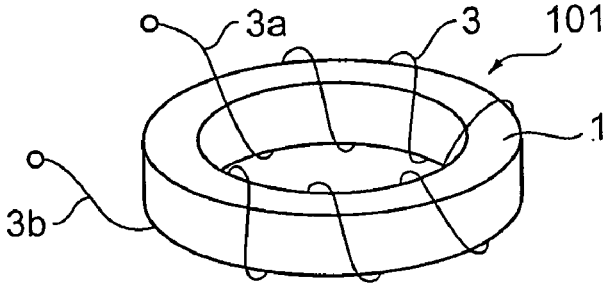
FIG. 2 is an external perspective view of an inductance component comprising the high-frequency core illustrated in FIG. 1 and a winding wound therearound.

FIG. 2 is an external perspective view showing an inductance component obtained by providing the high-frequency core 1 with a winding. FIG. 2 shows a state where a predetermined number of turns of winding 3 is wound around the high-frequency core 1 as the ring-shaped plate to produce the inductance component 101 with lead wire extracting parts 3*a* and 3*b*.

Figure 3:
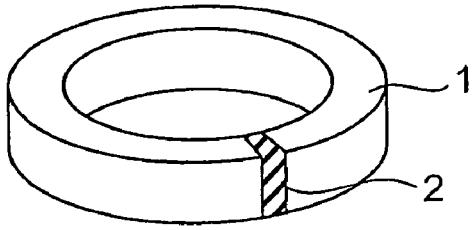
FIG. 3 is an external perspective view of a basic structure of a high-frequency core according to another embodiment of this invention.

FIG. 3 shows an external perspective view of a basic structure of a high-frequency core 1 according to another embodiment of this invention. FIG. 3 shows a state where the high-frequency core 1 using the above-mentioned soft magnetic metallic glass powder is formed into a ring-shaped plate and a gap 2 is formed at a part of a magnetic path. The gap 2 is a blank space or a space filled with an insulating material. As the insulating material, a heat-resistant insulating sheet is suitable.

Figure 4:
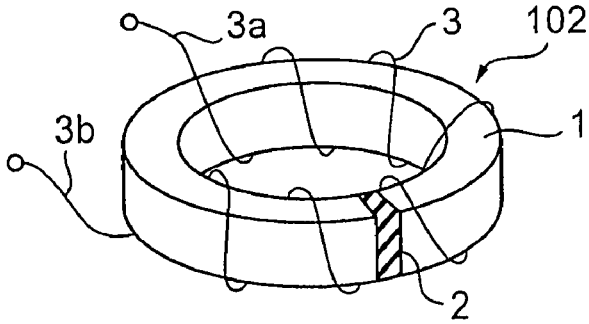
FIG. 4 is an external perspective view of an inductance component comprising the high-frequency core illustrated in FIG. 3 and a winding wound therearound.

FIG. 4 is an external perspective view of an inductance component 102 obtained by providing the high-frequency core 1 having the gap 2 with the winding 3. FIG. 4 shows a state where a predetermined number of turns of winding 3 is wound around the high-frequency core 1 as the ring-shaped plate having the gap 2 to produce the inductance component with the lead wire extracting parts 3*a* and 3*b*.

If a powder core is produced by molding a mixture of a soft magnetic metallic glass powder having the above-mentioned metallic glass composition and having the maximum particle size of 45 μm or less in mesh size and the average diameter of 30 μm or less and a binder in an amount of 10% or less in mass ratio with respect to the soft magnetic metallic glass powder, the powder core exhibits an extremely low loss characteristic at a high frequency and has an excellent performance never before achieved. By providing the powder core with a winding, the inductance component excellent in Q characteristic is obtained. Further, by press-molding a magnetic body with a winding coil embedded therein to form an integral structure, an inductance component adapted to a large high-frequency current is obtained.

Herein, the reason why the powder particle size is defined will be described in detail. If the maximum particle size exceeds 45 μm in mesh size, the Q characteristic in a high-frequency region is deteriorated. Further, unless the average diameter is 30 μm or less, the Q characteristic at 500 kHz or more does not exceed 40. Further, unless the average diameter is 20 μm or less, the Q value at 1 MHz or more is not 50 or more. The metallic glass powder is advantageous in that, since the specific resistance of the alloy itself is twice to ten times higher than conventional materials, the Q characteristic is high even at the same particle size. If the same Q characteristic is sufficient, a usable particle size range is widened so as to reduce a powder production cost.

Figure 5:
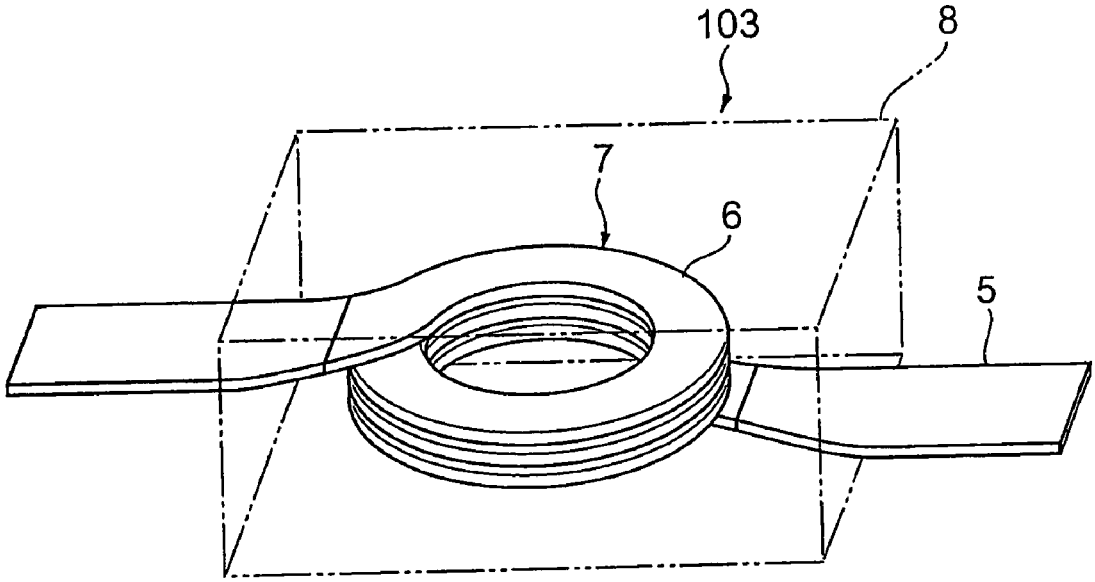
FIG. 5 is an external perspective view of a basic structure of an inductance component according to yet another embodiment of this invention.

FIG. 5 is an external perspective view of a basic structure of a high-frequency inductance component according to yet another embodiment of this invention. Referring to FIG. 5, a long plate material (strip material) 5 formed by the above-mentioned soft magnetic metallic glass powder is wound in a plate plane direction (horizontal direction in the figure) to obtain a winding coil 7. The winding coil is embedded in a magnetic body 8 comprising a mixture of a magnetic powder and a binder. In this state, press-molding is performed to obtain an integral structure as an inductance component 103. The winding coil 7 of the plate material 5 has parts protruding on opposite end faces of the magnetic body 8 to serve as lead terminals. An entire surface of a winding portion of the plate material 5 is provided with an insulating coating 6.

Now, the high-frequency core according to this invention and the inductance component using the same will be described in detail in conjunction with several examples and comparative examples, including production processes.

EXAMPLES 1–36, COMPARATIVE EXAMPLES 1–13

At first, as a powder preparing step, pure metal element materials including Fe, Si, B, Nb, and substitute elements therefor were weighed so as to obtain predetermined compositions. By the use of these materials, various kinds of soft magnetic alloy powders were produced by water atomization generally used. It is noted here that a misch metal is a mixture of rare earth metals. Herein, a mixture of 30% La, 50% Ce, 15% Nd, and the balance other rare earth element or elements was used.

Next, as a molded body preparing step, each of the alloy powders was classified into those having a powder size of 45 μm or less. Thereafter, a silicone resin as a binder was mixed in an amount of 5% in mass ratio. Then, by the use of a die with a groove having an outer diameter of $\phi_{OUT}$=27 mm×an inner diameter $\phi_{IN}$=14 mm, various kinds of molded bodies were formed by applying a pressure of $14.7\times10^8$ Pa at a room temperature so that the height was equal to 5 mm.

Further, the various kinds of molded bodies were subjected to resin curing. Thereafter, the weight and the size of each molded body were measured. Then, an appropriate number of turns of winding was provided to prepare various kinds of inductance components (having the shape illustrated in FIG. 2).

Next, for each of various samples of the inductance components, the permeability was obtained from the inductance value at 100 kHz by the use of an LCR meter. Further, by the use of a d.c. magnetic characteristics measuring instrument, measurement was made of the saturation magnetic flux density when a magnetic field of $1.6\times10^4$ A/m was applied. In addition, upper and lower surfaces of each core were polished and measurement by X-ray diffraction (XRD) was carried out to observe a phase. The results shown in Table 1 were obtained.

Table 1 shows composition ratios of the samples. Further, an XRD pattern obtained by XRD measurement is judged as a glass phase if only a broad peak specific to the glass phase was detected, as a (glass+crystal) phase if a sharp peak attributable to a crystal was observed together with a broad peak, and as a crystal phase if only a sharp peak was observed without a broad peak. For those samples of the compositions with the glass phase, a glass transition temperature and a crystallization temperature were measured as thermal analysis by DSC to confirm that a supercooled liquid temperature range ΔTx was 30 K or more for all those samples. The specific resistance was measured for the molded bodies (cores) by two-terminal d.c. measurement. As a result, it was confirmed that all samples exhibited excellent specific resistances not lower than 1 Ωcm.

The temperature elevation rate of DSC was 40 K/min. From the examples 1 to 3 and the comparative examples 1 and 2, it is understood that the core having a glass phase is obtained if the amount of Nb is 3 to 6%. However, it is seen that the magnetic flux density is as low as 0.75 T or less in the comparative example 2 where the amount of Nb is 6%. From the examples 4 to 10 and the comparative examples 3 to 6, it is understood that the core having a glass phase is obtained if the amount of Si is 1 or more, the amount of B is 25 or less, and the amount of Fe is 68 to 78. From the examples 11 to 16 and the comparative examples 7 and 8, it is understood that, by replacing a part of Fe with Ni, Co, the metallic glass powder is obtained even if the amount of Nb is 1%. However, it is seen that, if the replaced amount exceeds 0.3 for Ni and 0.5 for Co, the effect of improving the magnetic flux density is not obtained (in comparison with the example 1). As shown in the examples 17 to 20, it is also understood that Ni and Co may be added in combination and that the similar effect is obtained by the use of Ta, Mo instead of Nb.

From the examples 21 to 24 and the comparative examples 9 and 10, it is understood that the glass phase having a high permeability can not be formed if the amount of Nb is 1% while the glass phase can be formed if the amount is 2% or more. Further, it is understood that the saturation magnetic flux density is improved by replacing Nb by Zn but the glass phase can not be formed if the replacement ratio exceeds 0.5.

TABLE 1

| | alloy composition | magnetic flux density/T at $1.6\times10^4$ A/m | permeability at 100 kHz | XRD measurement result |
|---|---|---|---|---|
| comparative example 1 | $Fe_{74}Si_4B_{20}Nb_2$ | 0.92/T | 22 | crystal phase |
| example 1 | $Fe_{73}Si_4B_{20}Nb_3$ | 0.87 | 31 | glass phase |
| example 2 | $Fe_{72}Si_4B_{20}Nb_4$ | 0.82 | 33 | glass phase |
| example 3 | $Fe_{71}Si_4B_{20}Nb_5$ | 0.77 | 35 | glass phase |
| comparative example 2 | $Fe_{70}Si_4B_{20}Nb_6$ | 0.72 | 37 | glass phase |
| comparative example 3 | $Fe_{77}Si_0B_{20}Nb_3$ | 0.98 | 19 | crystal phase |

TABLE 1-continued

| | alloy composition | magnetic flux density/T at $1.6 \times 10^4$ A/m | permeability at 100 kHz | XRD measurement result |
|---|---|---|---|---|
| example 4 | $Fe_{76}Si_1B_{20}Nb_3$ | 0.95 | 30 | glass phase |
| example 5 | $Fe_{75}Si_2B_{20}Nb_3$ | 0.93 | 32 | glass phase |
| example 6 | $Fe_{73}Si_4B_{20}Nb_3$ | 0.87 | 34 | glass phase |
| example 7 | $Fe_{68}Si_9B_{20}Nb_3$ | 0.76 | 36 | glass phase |
| comparative example 4 | $Fe_{67}Si_{10}B_{20}Nb_3$ | 0.70 | 21 | crystal phase |
| comparative example 5 | $Fe_{79}Si_4B_{14}Nb_3$ | 0.95 | 20 | crystal phase |
| example 8 | $Fe_{78}Si_4B_{15}Nb_3$ | 0.94 | 33 | glass phase |
| example 9 | $Fe_{73}Si_4B_{20}Nb_3$ | 0.87 | 35 | glass phase |
| example 10 | $Fe_{68}Si_4B_{25}Nb_3$ | 0.80 | 37 | glass phase |
| comparative example 6 | $Fe_{67}Si_4B_{26}Nb_3$ | 0.79 | 23 | crystal phase |
| example 11 | $(Fe_{0.9}Ni_{0.1}Co_0)_{75}Si_4B_{20}Nb_1$ | 0.92 | 32 | glass phase |
| example 12 | $(Fe_{0.8}Ni_{0.2}Co_0)_{75}Si_4B_{20}Nb_1$ | 0.87 | 34 | glass phase |
| example 13 | $(Fe_{0.7}Ni_{0.3}Co_0)_{75}Si_4B_{20}Nb_1$ | 0.82 | 36 | glass phase |
| comparative example 7 | $(Fe_{0.6}Ni_{0.4}Co_0)_{75}Si_4B_{20}Nb_1$ | 0.77 | 38 | glass phase |
| example 14 | $(Fe_{0.9}Ni_0Co_{0.1})_{75}Si_4B_{20}Nb_1$ | 0.92 | 31 | glass phase |
| example 15 | $(Fe_{0.8}Ni_0Co_{0.2})_{75}Si_4B_{20}Nb_1$ | 0.95 | 33 | glass phase |
| example 16 | $(Fe_{0.5}Ni_0Co_{0.5})_{75}Si_4B_{20}Nb_1$ | 0.88 | 35 | glass phase |
| comparative example 8 | $(Fe_{0.4}Ni_0Co_{0.6})_{75}Si_4B_{20}Nb_1$ | 0.85 | 37 | glass phase |
| example 17 | $(Fe_{0.7}Ni_{0.1}Co_{0.2})_{75}Si_4B_{20}Nb_1$ | 0.88 | 34 | glass phase |
| example 18 | $(Fe_{0.7}Ni_{0.1}Co_{0.2})_{74}Si_4B_{20}Nb_2$ | 0.84 | 36 | glass phase |
| example 19 | $(Fe_{0.7}Ni_{0.1}Co_{0.2})_{74}Si_4B_{20}Ta_2$ | 0.84 | 34 | glass phase |
| example 20 | $(Fe_{0.7}Ni_{0.1}Co_{0.2})_{74}Si_4B_{20}Mo_2$ | 0.84 | 35 | glass phase |

TABLE 2

| | alloy composition | magnetic flux density/T at $1.6 \times 10^4$ A/m | permeability at 100 kHz | XRD measurement result |
|---|---|---|---|---|
| comparative example 9 | $Fe_{75}Si_7B_{17}Nb_1$ | 0.91 | 18 | crystal phase |
| example 21 | $Fe_{74}Si_7B_{17}Nb_2$ | 0.87 | 35 | glass phase |
| example 22 | $Fe_{73}Si_7B_{17}Nb3$ | 0.82 | 37 | glass phase |
| example 23 | $Fe_{73}Si_7B_{17}Nb_2Zn_1$ | 0.84 | 37 | glass phase |
| example 24 | $Fe_{73}Si_7B_{17}Nb_{1.5}Zn_{1.5}$ | 0.85 | 35 | glass phase |
| comparative example 10 | $Fe_{73}Si_7B_{17}Nb_1Zn_2$ | 0.86 | 19 | crystal phase |
| comparative example 11 | $Fe_{75}Si_7B_{17}Nb_1Zn_1$ | 0.93 | 17 | crystal phase |
| example 25 | $Fe_{74}Si_7B_{17}Nb_0Zn_1$ | 0.89 | 33 | glass phase |
| example 26 | $Fe_{71}Si_7B_{17}Nb_4Zn_1$ | 0.75 | 37 | glass phase |
| comparative example 12 | $Fe_{70}Si_7B_{17}Nb_5Zn_1$ | 0.68 | 35 | glass phase |
| example 27 | $Fe_{73}Si_7B_{17}Nb_2Sn_1$ | 0.81 | 35 | glass phase |
| example 28 | $Fe_{73.5}Si_7B_{17}Nb_2(\text{misch metal})_{0.5}$ | 0.85 | 35 | glass phase |
| example 29 | $(Fe_{0.9}Ni_{0.1}Co_0)_{74}Si_7B_{17}Nb_1Zn_1$ | 0.87 | 34 | glass phase |
| example 30 | $(Fe_{0.8}Ni_0Co_{0.2})_{74}Si_7B_{17}Nb_1Zn_1$ | 0.89 | 32 | glass phase |
| example 31 | $(Fe_{0.7}Ni_{0.1}Co_{0.2})_{74}Si_7B_{17}Nb_1Zn_1$ | 0.88 | 33 | glass phase |
| example 32 | $(Fe_{0.7}Ni_{0.1}Co_{0.2})_{73}Si_7B_{17}Ta_2Zn_1$ | 0.78 | 32 | glass phase |
| example 33 | $(Fe_{0.7}Ni_{0.1}Co_{0.2})_{73}Si_7B_{17}Mo_2Zn_1$ | 0.76 | 34 | glass phase |
| example 34 | $(Fe_{74}Si_{12}B_{12}Nb_2) + (Al_{0.05}C_{0.05}P_{0.05})$wt % | 0.86 | 33 | glass phase |
| example 35 | $(Fe_{73}Si_{10}B_{14}Nb_3) + (Al_{0.1}C_{0.1}P_{0.1})$wt % | 0.81 | 35 | glass phase |
| example 36 | $(Fe_{73}Si_{10}B_{14}Nb_3) + (Al_{0.3}C_{0.1}P_{0.1})$wt % | 0.80 | 33 | glass phase |
| comparative example 13 | $(Fe_{73}Si_{10}B_{14}Nb_3) + (Al_{0.2}C_{0.2}P_{0.2})$wt % | 0.80 | 15 | crystal phase |

As to the total amount of Zn and Nb, it is understood that 5% or less is appropriate from the examples 25 and 26 and the comparative examples 11 and 12. From the examples 27 and 28, it is understood that the similar effect is obtained if Sn or a misch metal is added instead of Zn. From the examples 29 to 31, it is understood that the similar effect is obtained if a part of Fe is replaced by Ni or Co and that these element may be added in combination. As shown in the examples 32 and 33, it is understood that the similar effect is obtained if Ta or Mo is used instead of Nb. As shown in the examples 34 to 36 and the comparative example 13, Al, C, and P may be added. However, if the total amount exceeds 0.5 mass %, an ability of forming an amorphous structure is remarkably deteriorated.

EXAMPLE 37

An alloy powder having a composition of $(Fe_{0.8}Ni_0Co_{0.2})_{75}Si_4B_{20}Nb_1$ was prepared by water atomization. The powder thus obtained was classified into those having a size of 75 μm or less. XRD measurement was carried out to confirm a broad peak specific to a glass phase. Next, thermal analysis by DSC was carried out to measure a glass transition temperature and a crystallization temperature to find out that ΔTx was 35K. Then, the powder was heat treated at 450° C. lower than the glass transition temperature for 0.5 hour in atmospheric air to form oxide on the surface of the powder. Next, the powder was mixed with 10%, 5%, 2.5%, 1%, and 0.5% silicone resin. By the use of a die of ϕ27×ϕ14, these powders were molded under three conditions at a room temperature, at 150° C. higher than a softening temperature of the resin, and at 550° C. in a supercooled liquid temperature range of this metallic glass powder. The powder filling rate, the magnetic flux density by d.c. magnetic characteristics measurement, and the d.c. specific resistance were measured. The results are shown in Table 3.

TABLE 3

| sample No. | resin content (%) | molding temperature | powder filling rate (%) | magnetic flux density/T at $1.6 \times 10^4$ A/m | specific resistance Ωcm |
|---|---|---|---|---|---|
| 1 | 0.5 | room temperature | 69.0 | 0.92 | ≧100 |
| 2 | 1 | room temperature | 69.9 | 0.93 | ≧100 |
| 3 | 2.5 | room temperature | 70.8 | 0.94 | ≧100 |
| 4 | 5 | room temperature | 70.3 | 0.94 | ≧100 |
| 5 | 10 | room temperature | 52.0 | 0.66 | $\geqq 10^4$ |
| 6 | 0.5 | 150° C. | 80.8 | 1.10 | 5 |
| 7 | 1 | " | 81.5 | 1.11 | 10 |
| 8 | 2.5 | " | 82.2 | 1.12 | 15 |
| 9 | 5 | " | 70.8 | 0.94 | ≧100 |
| 10 | 10 | " | 52.5 | 0.67 | $\geqq 10^4$ |
| 11 | 0.5 | 550° C. | 95.5 | 1.33 | 0.1 |
| 12 | 1 | " | 92.5 | 1.28 | 0.5 |
| 13 | 2.5 | " | 82.7 | 1.13 | 10 |
| 14 | 5 | " | 71.2 | 0.95 | ≧100 |
| 15 | 10 | " | 52.2 | 0.67 | $\geqq 10^4$ |

As seen from Table 3, the specific resistance has a value as high as $\geqq 10^4$ comparable to that of a ferrite core when the amount of the binder exceeds 5%. Because no special effect is obtained even if the molding temperature is elevated, molding at the room temperature is sufficient. Next, when the amount of the binder is equal to 5%, the specific resistance as high as 100 Ωcm or more is obtained and molding at the room temperature is sufficient. Next, it is understood that, when the content of the binder is equal to 2.5%, the powder filling rate is dramatically improved, the magnetic flux density is high, and the specific resistance of 10 Ωcm or more is obtained if molding is carried out at 150° C. Next, it is understood that, when the amount of the binder is 1% and 0.5%, the powder filling rate is dramatically improved, the saturation magnetic flux density is high, and the specific resistance of 0.1 Ωcm or more is obtained if molding is carried out at 550° C.

EXAMPLE 38

In an example 38, an alloy powder having a composition of $Fe_{73}Si_7B_{17}Nb_2Zn_1$ was prepared by water atomization. Thereafter, the powder thus obtained was classified into those having a particle size of 75 μm or less. Then, XRD measurement was carried out to confirm a broad peak specific to a glass phase. Further, thermal analysis by DSC was carried out to measure a glass transition temperature and a crystallization temperature to confirm that a vitrification start temperature range ΔTx was 35K. Then, the powder was kept at a temperature condition of 450° C. lower than the glass transition temperature and heat treated for 0.5 hour in atmospheric air to form oxide on the surface of the powder.

Next, the powder with oxide formed thereon was mixed with, in mass ratio, 10%, 5%, 2.5%, 1%, and 0.5% silicone resin as a binder. By the use of a die with a groove having an outer diameter $\phi_{OUT}$=27 mm×an inner diameter $\phi_{IN}$=14 mm, these powders were molded by applying a pressure of $11.8 \times 10^8$ Pa under three different temperature conditions, i.e., at a room temperature, at 150° C. higher than a softening temperature of the resin, and at 550° C. in a supercooled liquid temperature range of the soft magnetic metallic glass powder, so that the height was equal to 5 mm. Thus, various kinds of molded bodies were produced.

Next, the various kinds of molded bodies thus obtained were subjected to resin curing. Thereafter, the weight and the size of each molded body were measured. Then, an appropriate number of turns of winding was provided to prepare various kinds of inductance components (having the shape illustrated in FIG. 2).

Then, for each of various samples (Nos. 1–15) of the inductance components, the powder filling rate %, the magnetic flux density (at $1.6 \times 10^4$ A/m) by d.c. magnetic characteristics measurement, and the d.c. specific resistance Ωcm were measured. The results shown in Table 4 were obtained.

TABLE 4

| sample No. | resin content (%) | molding temperature | powder filling rate (%) | magnetic flux density/T at $1.6 \times 10^4$ A/m | specific resistance Ωcm |
|---|---|---|---|---|---|
| 1 | 0.5 | room temperature | 68.9 | 0.83 | ≧100 |
| 2 | 1 | room temperature | 69.7 | 0.84 | ≧100 |
| 3 | 2.5 | room temperature | 70.5 | 0.85 | ≧100 |
| 4 | 5 | room temperature | 70.1 | 0.84 | ≧100 |
| 5 | 10 | room temperature | 51.5 | 0.56 | $\geqq 10^4$ |
| 6 | 0.5 | 150° C. | 80.7 | 1.02 | 5 |
| 7 | 1 | 150° C. | 81.3 | 1.03 | 10 |
| 8 | 2.5 | 150° C. | 81.9 | 1.04 | 15 |
| 9 | 5 | 150° C. | 70.6 | 0.85 | ≧100 |
| 10 | 10 | 150° C. | 52.0 | 0.58 | $\geqq 10E^4$ |
| 11 | 0.5 | 550° C. | 95.4 | 1.21 | 0.1 |
| 12 | 1 | 550° C. | 92.2 | 1.17 | 0.5 |
| 13 | 2.5 | 550° C. | 82.4 | 1.05 | 10 |
| 14 | 5 | 550° C. | 71.0 | 0.85 | ≧100 |
| 15 | 10 | 550° C. | 51.7 | 0.57 | $\geqq 10^4$ |

As seen from Table 4, the specific resistance has a value as high as $\geqq 10^4$ comparable to that of a ferrite core when the amount of the binder (the amount of the resin) exceeds 5%. It is understood that no special effect is obtained even if the molding temperature is elevated and that the molding condition around the room temperature is sufficient. Further, it is understood that, when the amount of the resin is equal to 5%, the specific resistance as high as 100 Ωcm or more is obtained and that molding at the room temperature is similarly sufficient. Further, it is understood that, when the amount of the resin is equal to 2.5%, the powder filling rate is dramatically improved, the magnetic flux density is high, and the specific resistance of 10 Ωcm or more is obtained if molding is carried out at 150° C. In addition, it is understood that, when the amount of the resin is 1% and 0.5%, the powder filling rate is dramatically improved, the saturation magnetic flux density is high, and the specific resistance of 0.1 Ωcm or more is obtained if molding is carried out at 550° C.

EXAMPLE 39

By the use of the sample No. 12 in the example 37, the inductance characteristic was measured in comparison with various core materials. Further, a core prepared by the use of the same alloy powder and the same production process was heat treated at 500° C. for 0.5 hour in a nitrogen atmosphere to obtain another sample. The inductance characteristic of this sample is also shown. For standardization of the inductance value, the permeability was obtained for comparison. The core materials compared were Sendust, 6.5% silicon steel, and an iron-based amorphous metal.

TABLE 5

| sample name | magnetic flux density/T at $1.6 \times 10^4$ A/M | specific resistance Ωcm | Permeability — | core loss 20 kHz 0.1 T |
|---|---|---|---|---|
| this invention | 1.28 | 0.5 | 150 | 50/mW/cc |
| this invention (heat treated) | 1.29 | 0.4 | 200 | 30 |
| MnZn ferrite | 0.55 | $\geqq 10^4$ | 100* | 10 |
| Sendust | 0.65 | 100 | 80 | 100 |
| 6.5% silicon steel | 1.0 | 100μ | 100* | 250 |
| Fe-based amorphous metal | 1.3 | 150μ | 100* | 400 |

Note)
*with a gap inserted at a part of a magnetic path.

As seen from the above Table 5, the inductance component of this invention has a magnetic flux density equivalent to that of the inductance component using the amorphous metal and exhibits a core loss characteristic lower than that of the inductance component using Sendust. Therefore, the inductance component of this invention can be used as a very excellent inductance component. It has been confirmed that, in the inductance component using the heat-treated core, the permeability and the core loss are further improved.

EXAMPLE 40

In an example 40, an inductance component was produced by the use of a material corresponding to the sample No. 12 in the example 38. Further, another inductance component was prepared using a high-frequency core produced by the same alloy powder and the same production process and heat treated at 500° C. for 0.5 hour in a nitrogen atmosphere. Further, for comparison, inductance components (including the structure having a gap at a part of a magnetic path as shown in FIG. 4) were produced by the use of Sendust, 6.5% silicon steel, and a Fe-based amorphous metal as core materials, respectively. For those inductance components, the magnetic flux density (at $1.6\times10^4$ A/m) by d.c. magnetic characteristics measurement, the d.c. specific resistance Ωcm, the permeability for standardization of the inductance value, and the core loss (20 kHz 0.1 T) were measured. The results shown in Table 6 were obtained.

TABLE 6

| sample name | magnetic flux density/T at $1.6 \times 10^4$ A/M | specific resistance Ωcm | permeability — | core loss 20 kHz 0.1 T |
|---|---|---|---|---|
| this invention | 1.21 | 0.5 | 160 | 50/mW/cc |
| this invention (heat treated) | 1.23 | 0.4 | 220 | 25 |
| MnZn ferrite | 0.55 | $\geqq 10^4$ | 100* | 9 |
| Sendust | 0.65 | 100 | 80 | 100 |
| 6.5% silicon steel | 1.0 | 100μ | 100* | 250 |
| Fe-based amorphous metal | 1.3 | 150μ | 100* | 400 |

As seen from the above Table 6, the inductance component of this invention has a magnetic flux density substantially equivalent to that of the inductance component using the Fe-based amorphous metal as a core and yet exhibits a core loss lower than that of the inductance component using Sendust as a core. Therefore, the inductance component of this invention has a very excellent characteristic. It has been confirmed that, in the inductance component using the heat-treated core, the permeability and the core loss are further improved and more excellent characteristics are achieved.

EXAMPLE 41

In an example 41, an alloy powder having a composition of $Fe_{73}Si_7B_{17}Nb_3$ was prepared by water atomization. Thereafter, the powder thus obtained was classified into those having a particle size of 45 μm or less. Then, XRD measurement was carried out to confirm a broad peak specific to a glass phase. Further, thermal analysis by DSC was carried out to measure a glass transition temperature and a crystallization temperature to confirm that a supercooled liquid temperature range ΔTx was 35K. Then, powders obtained by water atomization and having following alloy compositions were filtered by a standard sieve into the powders of 20 μm or less. These powders were mixed at ratios shown in Table 7.

Further, using the powders thus obtained, a silicone resin as a binder was mixed in an amount of 1.5% in mass ratio. By the use of a die with a groove having an outer diameter $\phi_{OUT}$=27 mm×an inner diameter $\phi_{IN}$=14 mm, these powders were molded at a room temperature by applying a pressure of $11.8\times10^8$ Pa so that the height was equal to 5 mm. Thus, various kinds of molded bodies were produced. After molding, heat treatment was carried out in Ar at 500° C.

Next, the various kinds of molded bodies thus obtained were subjected to resin curing. Thereafter, the weight and the size of each molded body were measured. Then, an appropriate number of turns of winding was provided to prepare various kinds of inductance components (having the shape illustrated in FIG. 2).

Then, for each of the various samples of the inductance components, the powder filling rate %, the permeability, and the core loss (20 kHz 0.1 T) were measured. The results shown in Table 7 were obtained.

TABLE 7

| sample No. | | alloy composition | added powder ratio (mass %) | powder filling rate (vol %) | magnetic permeability at 100 kHz | core loss 20 kHz 0.1 T |
|---|---|---|---|---|---|---|
| comparative example | | — | — | 71.5 | 35 | 25 kW/m$^3$ |
| this invention | 1 | 3% SiFe | 5 | 72.1 | 37 | 30 |
| | 2 | " | 10 | 72.7 | 39 | 40 |
| | 3 | " | 20 | 73.3 | 40 | 60 |
| | 4 | " | 30 | 74 | 41 | 70 |
| | 5 | " | 40 | 74.5 | 42 | 80 |
| | 6 | " | 50 | 75.0 | 44 | 90 |
| | 7 | " | 60 | 75.2 | 44 | 200 |
| | 8 | sendust | 30 | 72.7 | 38 | 80 |
| | 9 | Mo permalloy | 30 | 75.0 | 43 | 85 |
| | 10 | pure iron powder | 30 | 76.5 | 48 | 95 |

As seen from Table 7, the inductance component of this invention is improved in powder filling rate by adding to the metallic glass powder the soft magnetic powder smaller in particle size, and is consequently improved in permeability. On the other hand, if the added amount exceeds 50%, the improving effect is weakened and the core loss characteristic is significantly degraded. Therefore, it is understood that the added amount is preferably 50% or less.

EXAMPLE 42

In an example 42, alloy powders having a composition of $Fe_{73}Si_7B_{17}Nb_3$ were prepared by water atomization. By changing various production conditions, powders having aspect ratios shown in Table 8 were prepared. Thereafter, the powders thus obtained were classified into those having a particle size of 45 μm or less. Then, XRD measurement was carried out to confirm a broad peak specific to a glass phase.

Further, thermal analysis by DSC was carried out to measure a glass transition temperature and a crystallization temperature to confirm that a supercooled liquid temperature range ΔTx was 35K.

Further, using the powders thus obtained, a silicone resin as a binder was mixed in an amount of 3.0% in mass ratio. By the use of a die with a groove having an outer diameter $\phi_{OUT}$=27 mm×an inner diameter $\phi_{IN}$=14 mm, these powders were molded at a room temperature by applying a pressure of $14.7\times10^8$ Pa so that the height was equal to 5 mm. Thus, various kinds of molded bodies were produced. After molding, heat treatment was carried out in Ar at 500° C.

Next, the various kinds of molded bodies thus obtained were subjected to resin curing. Thereafter, the weight and the size of each molded body were measured. Then, an appropriate number of turns of winding was provided to prepare various kinds of inductance components (having the shape illustrated in FIG. 2).

Then, for each of the various samples of the inductance components, the powder filling rate % and the permeability were measured. The results shown in Table 8 were obtained.

TABLE 8

| sample No. | | aspect ratio | powder filling rate (vol %) | magnetic permeability at 100 kHz |
|---|---|---|---|---|
| comparative example | | 1.1 | 68 | 26 |
| this invention | 1 | 1.6 | 67 | 32 |
| | 2 | 2.1 | 65 | 42 |
| | 3 | 2.5 | 63 | 52 |
| | 4 | 2.9 | 60 | 62 |
| | 5 | 3.3 | 52 | 59 |

As seen from Table 8, the inductance component of this invention is improved in permeability by increasing the aspect ratio of the metallic glass powder. On the other hand, if the aspect ratio exceeds 3.0, the permeability is degraded under the influence of reduction in powder filling rate. Therefore, it is understood that the aspect ratio of the powder is preferably 3 or less.

EXAMPLE 43

At first, as a powder preparing step, materials generally used in industrial applications were weighed so as to obtain the composition of $FeSi_9B_{14}Nb_3$. By the use of the materials, soft magnetic alloy fine powders different in average diameter were prepared by high-pressure water atomization.

Next, as a molded body preparing step, the alloy powders thus obtained were filtered by various types of standard sieves to prepare powders shown in Table 9. Thereafter, a silicone resin as a binder was mixed in an amount of 3% in mass ratio. Then, by the use of a die of 10 mm×10 mm, each powder was molded, together with a winding coil having an outer diameter of $\phi_{OUT}$=8, an inner diameter $\phi_{IN}$=4 mm and a height of 2 mm and arranged so that, after molding, the winding coil is positioned at an exact center of a molded body, by applying a pressure of $4.9\times10^8$ Pa at a room temperature so that the height was equal to 5 mm. Thus, molded bodies were formed. Next, resin curing was performed at 150° C. As to a sample No. 5, another sample was also prepared by heat treating the inductance component at 500° C. for 0.5 Hr in nitrogen.

Next, for each of the various samples of the inductance components, the inductance and the resistance were measured at various frequencies by the use of an LCR meter. From the measurements, the inductance value at 1 MHz, the peak frequency of Q, and the peak value of Q were obtained. The results shown in Table 9 were obtained.

Next, for the same samples of the inductance components, a power conversion efficiency was measured by the use of an evaluation kit for a typical DC/DC converter. The results are as follows. The measurement condition was an input of 12 V, an output of 5 V, a drive frequency of 300 kHz, and an output current of 1 A.

TABLE 9

| sample No. | mesh particle size μm | average diameter (D50) μm | L (μH) at 1 MHz | peak frequency of Q | peak value of Q | power conversion efficiency |
|---|---|---|---|---|---|---|
| comparative example 1 | 45 | 34 | 0.59 | 300 kHz | 30 | 79.5% |
| 1 | | 29 | 0.62 | 600 kHz | 42 | 83.0 |
| 2 | | 24 | 0.65 | 800 kHz | 45 | 83.5 |
| 3 | | 19 | 0.68 | 1.5 MHz | 60 | 85.0 |
| 4 | | 16 | 0.66 | 2.5 MHz | 65 | 85.2 |
| 5 | | 11 | 0.64 | 3.5 MHz | 75 | 85.5 |
| 5 (heat treated) | | | 0.72 | 3.0 MHz | 80 | 87.1 |
| comparative example 2 | 63 | 28 | 0.67 | 400 kHz | 35 | 79.8 |

As seen from Table 9, in the inductance component of this invention, when the mesh particle size was 45 μm or less and the average diameter was 30 μm or less, the peak frequency of Q was 500 kHz or more and its value was 40 or more. At that time, the power conversion efficiency was as excellent as 80% or more. When the mesh particle size was 45 μm or less and the average diameter was 20 μm or less, the peak frequency of Q was 1 MHz or more and its value was 50 or more. At that time, the power conversion efficiency was as more excellent as 85% or more. Further, it is understood that, by heat treating the inductance component, the conversion efficiency is further improved.

As described above, in the high-frequency core according to this invention, the soft magnetic metallic glass powder superior in economic efficiency is selected so that the alloy composition (Fe, Co, Ni)—(Al, Si, C, P)—B-MM' (M=at least one selected from Zr, Nb, Ta, Hf, Mo, Ti, V, Cr, and W. M'=at least one selected from Zn, Sn, and R (R being at least one element selected from rare earth metals including Y)) is defined. This makes it possible to obtain the powder excellent in magnetic characteristics and glass forming performance. Further, the powder is subjected to oxidization or insulating coating and molded by the use of a die or the like using an appropriate molding method to obtain a molded body. In this manner, the powder core is prepared. Therefore, a high-permeability powder core which exhibits excellent permeability characteristics over a wide band and which is never known is obtained. As a result, it is possible to economically produce a high-frequency core of a soft magnetic material having a high saturation magnetic flux density and a high specific resistance. Further, an inductance component comprising the high-frequency core and at least one turn of winding wound therearound is obtained as an economical and high-performance product which has never been obtained. Accordingly, this invention is extremely useful in industrial application.

In this invention, if the metallic glass powder having a maximum particle size of 45 μm or less in mesh size and an average diameter of 30 μm or less, more desirably 20 μm or less, is used, a powder core having an extremely low loss characteristic at a high frequency is obtained. An inductance component comprising the high-frequency core with at least one turn of winding wound therearound is extremely excellent in Q characteristic so that the power supply efficiency can be improved. Thus, this invention is very useful in industrial application.

Further, in this invention, the metallic glass powder having a maximum particle size of 45 μm or less in mesh size and an average diameter of 30 μm or less, more desirably 20 μm or less, is press-molded with a winding coil embedded in a magnetic body to form an integral structure. In this event, in addition to the excellent core characteristics specific to the metallic glass, heat generation resulting from an electric current flowing through the winding coil is radiated through the metal magnetic body. By the synergetic effect thereof, it is possible to obtain an inductance component increased in rated current for the same shape.

The high-frequency core according to this invention is economically obtained by the use of the soft magnetic metallic glass material having a high saturation magnetic flux density and a high specific resistance. Further, the inductance component obtained by providing the core with the winding is excellent in magnetic characteristics in a high-frequency band as never before. Thus, it is possible to produce a high-permeability powder core low in cost and high in performance as never before and to provide an inductance component, such as a choke coil and a transformer, as a power supply component of various electronic apparatuses.

By the use of the high-frequency core obtained by molding the powder having a fine particle size in this invention, a higher-performance inductance component at a high frequency can be produced.

Further, in the high-frequency core obtained by molding the powder having a fine particle size, press-molding may be carried out with the winding coil embedded in the magnetic body to form an integral structure. Thus, the inductance component small in size and adapted to a large current can be produced.

INDUSTRIAL APPLICABILITY

The high-frequency core according to this invention is economically obtained by the use of the soft magnetic metallic glass material having a high saturation magnetic flux density and a high specific resistance. Further, the inductance component obtained by providing the core with the winding is excellent in magnetic characteristics in a high-frequency band as never before. Thus, a high-permeability powder core low in cost and high in performance as never before can be produced and is suitably used in a power supply component, such as a choke coil and a transformer, of various electronic apparatuses.

The invention claimed is:

1. A high-frequency core comprising a molded body obtained by molding a mixture of a soft magnetic metallic glass powder and a binder in an amount of 10% or less in mass ratio with respect to the soft magnetic metallic glass powder, said soft magnetic metallic glass powder having an alloy composition represented by a general formula $(Fe_{1-a-b}Ni_aCo_b)_{100-x-y-z}(M_{1-p}M'_p)_xT_yB_z$ (where $0 \leqq a \leqq 0.30$, $0 \leqq b \leqq 0.50$, $0 \leqq a+b \leqq 0.50$, $0 \leqq p \leqq 0.5$, 1 atomic $\% \leqq x \leqq 5$ atomic %, 1 atomic $\% \leqq y \leqq 12$ atomic %, 12 atomic $\% \leqq z \leqq 25$ atomic %, $22 \leqq (x+y+z) \leqq 32$, M being at least one selected from Zr, Nb, Ta, Hf, Mo, Ti, V, Cr, and W, M' being at least one selected from Zn, Sn, R ,where R is at least one element selected from rare earth metals including Y, and T is at least one selected from Al, Si, C, and P).

2. The high-frequency core according to claim 1, wherein the total amount of Al, C, and P is 0.5% or less in mass ratio.

3. The high-frequency core according to claim 1, wherein the molded body has a powder filling rate of 50% or more, a magnetic flux density of 0.5 T or more when a magnetic field of $1.6 \times 10^4$ A/m is applied, and a specific resistance of $1 \times 10^4$ Ωcm or more.

4. The high-frequency core according to claim 1, wherein the molded body is obtained by preparing the mixture of the soft magnetic metallic glass powder and the binder in an amount of 5% or less in mass ratio with respect to the soft magnetic metallic glass powder and compression-molding the mixture using a die, the molded body having a powder filling rate of 70% or more, a magnetic flux density of 0.75 T or more when a magnetic field of $1.6 \times 10^4$A/m is applied, and a specific resistance of 1 Ωcm or more.

5. The high-frequency core according to claim 1, wherein the molded body is obtained by preparing the mixture of the soft magnetic metallic glass powder and the binder in an amount of 3% or less in mass ratio with respect to the soft magnetic metallic glass powder and compression-molding the mixture using a die under a temperature condition not lower than a softening point of the binder, the molded body having a powder filling rate of 80% or more, a magnetic flux density of 0.9 T or more when a magnetic field of $1.6 \times 10^4$ A/m is applied, and a specific resistance of 0.1 Ωcm or more.

6. The high-frequency core according to claim 1, wherein the molded body is obtained by preparing the mixture of the soft magnetic metallic glass powder and the binder in an amount of 1% or less in mass ratio with respect to the soft magnetic metallic glass powder and compression-molding the mixture at a temperature within a supercooled liquid temperature range of the soft magnetic metallic glass powder, the molded body having a powder filling rate of 90% or more, a magnetic flux density of 1.0 T or more when a magnetic field of $1.6 \times 10^4$A/m is applied, and a specific resistance of 0.01 Ωcm or more.

7. The high-frequency core according to claim 1, wherein the soft magnetic metallic glass powder is produced by water atomization or gas atomization and at least 50% of powder particles have a size not smaller than 10 μm.

8. The high-frequency core according to claim 1, wherein a soft magnetic alloy powder having an average diameter smaller than that of the soft magnetic metallic glass powder and a low hardness is added in an amount of 5–50% in volume ratio.

9. The high-frequency core according to claim 1, wherein the soft magnetic metallic glass powder has an aspect ratio (long axis/short axis) within a range between 1 and 3.

10. The high-frequency core according to claim 1, wherein the molded body is heat treated at a temperature not lower than a Curie point of the alloy powder after molding, $SiO_2$ being contained at least in a part of an intermediate material between powder particles of the alloy powder.

11. The high-frequency core according to claim 1, wherein the soft magnetic metallic glass powder has a maximum particle size of 45 μm or less in mesh size and an average diameter of 30 μm or less.

12. An inductance component comprising the high-frequency core claimed in claim 1 and at least one turn of winding wound around the core.

13. The inductance component according to claim 12, wherein a gap is formed at a part of a magnetic path of the high-frequency core.

14. The inductance component comprising the high-frequency core claimed in claim 11 and a winding coil embedded in a magnetic body and formed by press-molding into an integral structure.

15. The inductance component according to claim 11, wherein the high-frequency core has a powder filling rate of 50% or more and a peak value of Q (1/tan δ) is 40 or more at 500 kHz or more.

16. The inductance component according to claim 11, wherein the high-frequency core has a maximum powder particle size of 45 μm or less in mesh size and an average diameter of 20 μm or less and that a peak value of Q(=1/tan δ) is 50 or more at 1 MHz or more.

17. The inductance component according to claim 11, wherein heat treatment at a temperature not higher than 600° C. is performed.

* * * * *